US005175982A

United States Patent [19]

Stahlecker

[11] Patent Number: 5,175,982

[45] Date of Patent: Jan. 5, 1993

[54] PROCESS AND AN ARRANGEMENT FOR FEEDING SLIVERS TO A SPINNING UNIT

[75] Inventor: Fritz Stahlecker, Josef-Neidhart-Strasse 18, 7345 Bad Überkingen, Fed. Rep. of Germany

[73] Assignees: Fritz Stahlecker; Hans Stahlecker, both of Fed. Rep. of Germany

[21] Appl. No.: 719,010

[22] Filed: Jun. 21, 1991

[30] Foreign Application Priority Data

Jun. 26, 1990 [DE] Fed. Rep. of Germany ..... 4020292

[51] Int. Cl.[5] ..... D01H 15/013

[52] U.S. Cl. ..... 57/22; 57/261; 57/264

[58] Field of Search ..... 57/22, 261, 263, 264, 57/279, 281

[56] References Cited

U.S. PATENT DOCUMENTS

| | | | |
|---|---|---|---|
| 4,598,539 | 7/1986 | Stahlecker et al. | 57/263 |
| 4,833,874 | 5/1989 | Stahlecker et al. | 57/261 |
| 4,939,895 | 7/1990 | Raasch et al. | 57/263 |
| 4,958,486 | 9/1990 | Stahlecker | 57/261 |
| 4,964,268 | 10/1990 | Stahlecker | 57/261 |
| 4,969,323 | 11/1990 | Stahlecker | 57/22 X |
| 4,982,563 | 1/1991 | Stahlecker | 57/263 X |
| 5,044,148 | 9/1991 | Fujiwara | 57/261 X |

FOREIGN PATENT DOCUMENTS

| | | | |
|---|---|---|---|
| 361306 | 4/1990 | European Pat. Off. | 57/22 |
| 389439 | 9/1990 | European Pat. Off. | 57/22 |
| 3800810 | 8/1988 | Fed. Rep. of Germany . | |
| 3802413 | 8/1989 | Fed. Rep. of Germany . | |
| 3813368 | 11/1989 | Fed. Rep. of Germany | 57/22 |
| 3817222 | 11/1989 | Fed. Rep. of Germany | 57/22 |
| 3822294 | 2/1990 | Fed. Rep. of Germany | 57/22 |
| 3905942 | 9/1990 | Fed. Rep. of Germany | 57/22 |
| 34652 | 8/1972 | Japan | 57/22 |

*Primary Examiner*—Joseph J. Hail, III

*Attorney, Agent, or Firm*—Evenson, Wands, Edwards, Lenahan & McKeown

[57] ABSTRACT

In a process and apparatus for spinning a package with a double yarn, which is used as a feed package for a subsequent twisting operation, it is provided that, when one or both fed slivers run out, an automatic splicing of new slivers is carried out.

28 Claims, 3 Drawing Sheets

PROCESS AND AN ARRANGEMENT FOR FEEDING SLIVERS TO A SPINNING UNIT

BACKGROUND AND SUMMARY OF THE INVENTION

This invention relates to a process and apparatus for reading two slivers to a spinning unit which are each taken out of a sliver feed and which are drafted and spun in the spinning unit, after which the two yarn components are guided together to form a double yarn and, as a double yarn, are wound onto a package which is used as a feeding package for a subsequent twisting.

In the case of a process and an arrangement of the initially mentioned type (German Patent Document DE-A 38 00 810), it is known to monitor the presence of the two entering slivers which are withdrawn from spinning cans or from sliver wind-up machines. Even if only one sliver is absent, the spinning operation is interrupted.

It is an object of the invention to provide a process of the initially mentioned type by means of which, when one or both of the slivers run out, a piecing of new slivers is carried out in such a manner that as little fiber material as possible will be lost.

According to a first solution proposed by the present invention, it is provided that, when one or both slivers run out, the possibly still existing sliver is cut off, new sliver feeds are applied to the spinning unit, and the two sliver ends are each connected with the starting portion of a new sliver at points which are offset with respect to one another in the travelling direction.

This first solution is based on the fact that in many cases, because of the formation of the connecting points that is offset in the travelling direction, no impermissible thick points are formed in the yarn so that the spinning operation can be continued virtually without any loss of fiber material after the running-out of one or of both slivers.

In this solution, it is provided in an advantageous further development of certain preferred embodiments of the invention that the double yarn is monitored with respect to thick points. When an excessive thick point occurs, the spinning operation is interrupted, after which a piecing is carried out during which the thick point is removed from the double yarn travelling onto the spool package. This measure is particularly advantageous when a double yarn is spun from very fine yarn components on which high demands are made with respect to quality as far as uniformity is concerned.

According to a second solution proposed by the present invention, it is provided that, when one or both slivers run out, the possibly still existing sliver is cut off, new sliver feeds are applied to the spinning units, the two sliver ends are connected at connecting points situated side-by-side with the starting portion of a respective new sliver, and the sections of the yarn components containing the connecting points are subsequently separated from the production of the double yarn.

In this solution, it is basically provided that the connecting points between the old incoming slivers and the new slivers do not enter into the double yarn which remains on the spool and is to be processed later. However, in this case, the amount of fiber material that must be removed, is limited to a minimum.

In a further development of certain preferred embodiments of this solution of the invention, it is provided that, when one or both of the slivers run out, the spinning operation is interrupted and that, after the connecting of the sliver ends with the starting portion of one new sliver respectively, a piecing is carried out during which, before or during the piecing according to certain preferred embodiments of the invention, the sections of the yarn components are removed which contain the connecting points. When the sections containing the connecting points are removed before the piecing according to other preferred embodiments of the invention, this may be carried out by the control of the spinning unit which carries out a corresponding method of operation as a result of the signals indicating the absence of the slivers. If the removal takes place during the piecing, this can be carried out by a servicing arrangement which carries out the piecing. In this case, the servicing arrangement receives a corresponding signal from the control of the spinning unit which causes the servicing device to carry out a special piecing program which is designed for the removal of the sections of the yarn components containing the connecting points.

In a further development of preferred embodiments of the second solution, it is provided that the spinning operation is interrupted after the connecting of the ends of the slivers with the starting portion of a respective new sliver and after the section of the double yarn containing the connecting points has moved onto the spool package, and that subsequently a piecing operation is carried out in which the section of the double yarn is removed which contains the connecting points. In the case of this process, it may be provided that the piecing of the new slivers is carried out without the interruption of the spinning operation. However, it is also contemplated in certain embodiments to interrupt the spinning operating for the piecing of the new slivers, then carry out a piecing operation, and then interrupt the spinning operation again and subsequently carry out the piecing operation with the removal of the section of the double yarn which contains the connecting points. In this case, the fiber quantity which corresponds to the connecting points does not have to be removed by devices that are part of the machine. On the contrary, this may be carried out by a servicing device which carries out the piecing operation and which is equipped with a collecting container for the fiber quantity to be removed which can be emptied.

In a further development of preferred embodiments of the invention, it is provided that, for carrying out the process, the spinning unit is equipped on its inlet side with devices for detecting the presence or absence of the slivers which are assigned to both slivers, with devices for cutting the slivers and with at least one part of devices for connecting the ends of the two incoming slivers, in each case, with a starting portion of a new sliver.

Other objects, advantages and novel features of the present invention will become apparent from the following detailed description of the invention when considered in conjunction with the accompanying drawings.

DETAILED DESCRIPTION OF THE DRAWINGS

Figure 1:
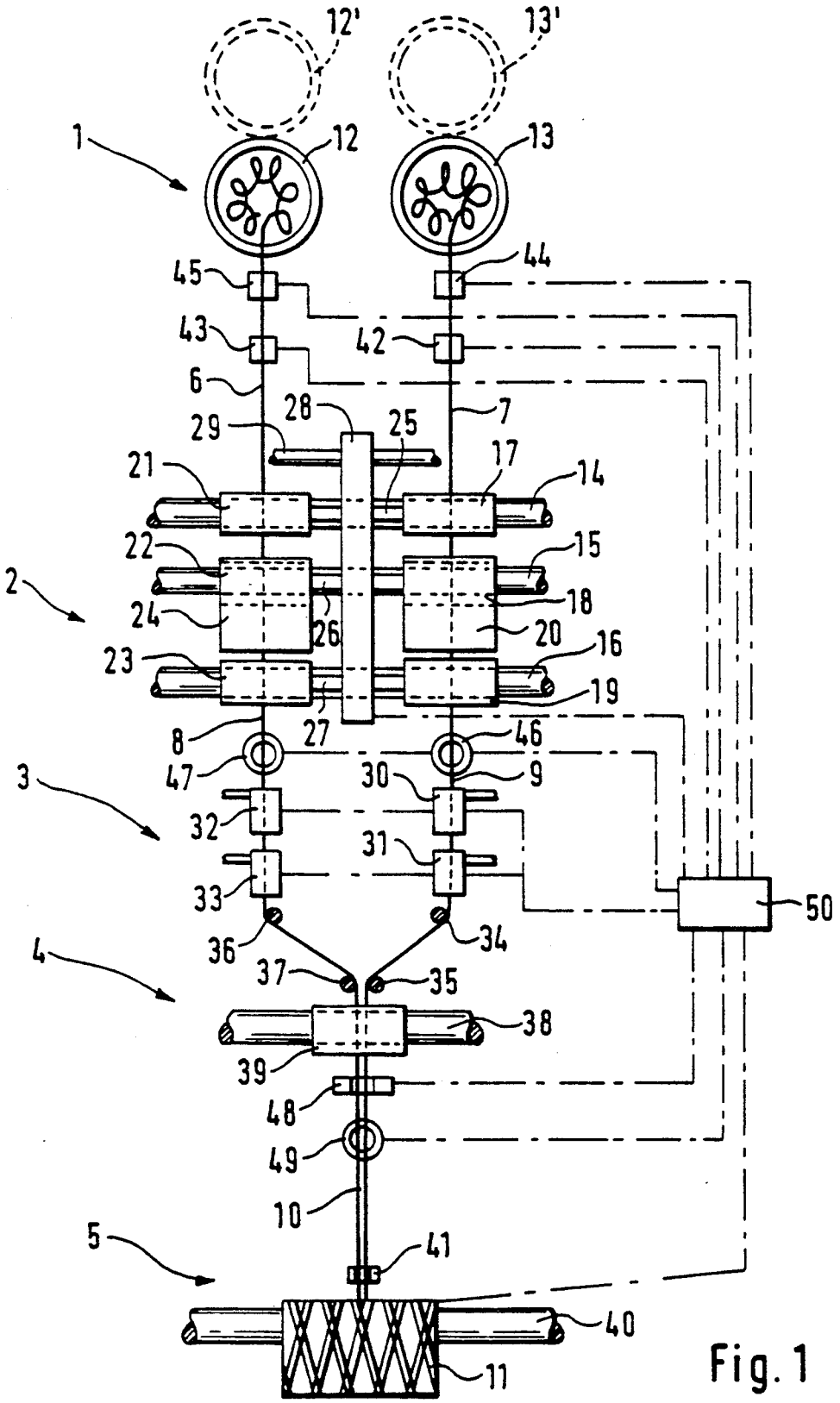
FIG. 1 is a largely schematic representation of a spinning unit for producing a double yarn which is wound onto a spool package which is used as a feeding package for a subsequent twisting. constructed according to a preferred embodiment of the invention.

The shown spinning unit of FIG. 1 is an individual unit of a machine which is formed of a plurality of spinning units of this type. The spinning unit includes a sliver feed point 1, a drafting device 2, a twisting device 3, a withdrawal device 4, and a wind-up device 5.

By means of the spinning unit, two slivers 6, 7 are processed simultaneously which are taken out of spinning cans 12, 13 situated at the feed point 1. The slivers 6, 7 travel into drafting units which in the embodiment shown are constructed as three-cylinder drafting units. Drafting units with more cylinders may also be used according to other contemplated embodiments. The drafting units comprise bottom rollers 14, 15, 16 to which respective top rollers 17, 18, 19 are assigned for sliver 7 and top rollers 21, 22, 23 for sliver 6. The top rollers 17 to 19 and 21 to 23 are constructed as so-called pressure roller twins, the shafts 25, 26, 27 of which are carried by a common weighing arm 28 which can be swivelled about a shaft 29 extending in parallel to the bottom rollers 14, 15, 16. In the main drafting zone, the drafting units comprise apron guides 20, 24.

The twisting device 3 comprises two air nozzles 30, 31, 32, 33 respectively which are arranged behind one another and of which the first air nozzle 30, 32 is constructed in each case as an intake nozzle or collecting nozzle, while the respective second air nozzle 31, 33 is constructed as a twisting nozzle by means of which the drafted yarn components 8, 9, which leave the drafting units, are provided with a false twist. By means of this false twisting, in a known manner, preferably only a prestrengthening of the yarn components 8, 9 is carried out; that is, a spinning into yarn components which have only a relatively low strength.

The yarn components, which leave the air nozzles 31, 33, by means of yarn guiding elements 34, 35; 36, 37, are guided together in front of the withdrawal device 4 to form a double yarn 10. The withdrawal device 4 comprises a driven shaft 38 which extends through in the longitudinal direction of the machine, as well as one pressure roller 39 respectively.

The double yarn 10 is wound up into a package 11 by the wind-up device 5, in which case, the yarn components 8, 9 of the double yarn 10 are disposed side-by-side without being connected with one another. The package 11 is used as a feed package for a subsequent twisting by which the double yarn 10 only then receives the strength which is required for a further processing. The wind-up device 5 comprises a winding roller 40, which extends through in the longitudinal direction of the machine and which drives the package 11 which, in a manner not shown in detail, is received by a spool frame. A cross-winding device 41, which is only outlined, is assigned to the wind-up device 5. The cross-winding device 41 caries out a movement by which the double yarn 10 is placed in such a manner that a cross-wound package is obtained.

On the inlet side, the spinning unit also comprises two sliver detectors 44, 45 which are assigned to the slivers 6, 7. As indicated by dash-dotted lines, the two sliver detectors 44, 45, which are preferably constructed as optical or electronic sliver detectors, are connected to a control unit 50. The sliver detectors 44, 45 report the absence of one or both slivers 6, 7 as soon as these are used up and the end of these slivers 6, 7 passes by these sliver detectors 44, 45.

On the inlet side, additional devices 42, 43 are arranged for connecting the end of the entering slivers 6, 7 with the starting portion of new slivers. These devices 42, 43 for the connecting will be explained later with reference to FIG. 2.

The control 50 is also connected with a device for interrupting the spinning operation. This device comprises, for example, a pneumatic cylinder, which is not shown, which is applied to the weighing arm 28, and by means of which the weighing arm 28 can be swivelled in such a manner that the drafting units are opened up; that is, that the top rollers 17, 18, 19; 21, 22, 23 are swivelled away from the pertaining bottom rollers 14, 15, 16 so that then the further entering of the slivers 6, 7 will be interrupted. The control 50 controls, for example, a solenoid valve, which is arranged in the supply line to the pneumatic cylinder.

The control 50 is also connected with suction nozzles 46, 47. These suction nozzles 46, 47 are arranged between the drafting units and the air nozzles 30, 31; 32, 33 in such a manner that, when a spinning operation is interrupted during which the air nozzles 30, 31; 32, 33 are lowered and moved out of the area of the drafting units, suction nozzles 46, 47 are applied to the outlet area of the drafting unit instead of these air nozzles. These suction nozzles 46, 47 may constantly be acted upon by a vacuum in which case, during the normal operation, they are moved out of the position shown in FIG. 1 and are applied to the circumference of the bottom roller 16. As indicated by dash-dotted lines, the control 50 is connected with the devices for the adjusting of the suction nozzles 46, 47. In a similar manner, the control is connected with the air nozzles 30, 31; 32, 33, in which case, the control may also be connected with control valves or shut-off valves which are arranged in the compressed-air supply system leading to the air nozzles 30, 31; 32, 33.

Following the withdrawal device 4, a yarn cleaner 48 is connected which monitors the double yarn 10 with respect to impermissible thick points. The yarn cleaner 48 is also connected to the control 50.

In addition, between the withdrawal device 4 and the wind-up device 5, a suction nozzle 49 is arranged which is directed onto the double yarn 10. This suction nozzle 49 is connected to a vacuum supply line which contains a shut-off valve that can be controlled by the control 50.

Furthermore, the control 50, as also indicated by a dash-dotted line, is connected to a device, which is not shown, by means of which the package 11 can be lifted off the driving shaft 40.

The spinning unit also comprises yarn detectors which are preferably arranged directly behind the air nozzles 31, 33 and which report the breakage of a yarn component. Subsequently, the control triggers an interruption of the spinning operation according to a specified program which will not be explained here in detail because it is not important for an understanding of the invention since one skilled in the art would be able to provide this control based on the present application disclosure and the state of the art. In the case of this switch-off program, the suction nozzle 49 is activated in such a manner and the package 11 is also lifted off its shaft 40 such that the unbroken yarn component will not travel onto the package 11 but is held in the area of the suction device 49. The control is also equipped with devices which are not shown and by means of which it sets a signal which calls an automatic servicing device which, after a yarn breakage, carries out a piecing operation at the concerned spinning unit in order to restart this spinning unit.

After the fiber material fed in the cans 12, 13 is used up, that is, the slivers 6, 7 are withdrawn from the cans 12, 13, the respective ends of these slivers 6, 7 passes through the yarn detectors 44, 45 so that a report is made to the control that the sliver is used up. By means of the devices 42, 43, the starting portion of a new sliver, which is taken out of the cans 12', 13' situated in a readiness position, is then pieced to the sliver ends so that the spinning operation may be continued. As a rule, it may be assumed that the cans 12, 13 will be empty at approximately the same time. Certain differences may be caused by the fact that differences occur during the spinning operation because of yarn breakages or the like. Nevertheless, it may be assumed that in practice it is useful to exchange both cans 12, 13 simultaneously and to carry out a piecing of the new sliver at both slivers 6, 7 simultaneously.

A first process provides that the piecing of the starting portions of the new slivers to the ends of the entering slivers 6, 7 takes place at points which are offset with respect to one another. As a result, it is avoided that an accumulation of fiber material takes place simultaneously on both slivers 6, 7. This offset connecting may be achieved in a simple manner by the fact that the devices 42, 43, deviating from the illustrated positions in FIG. 1, are arranged at positions that are offset with respect to one another. For example, the device 42 is disclosed closer to the inlet roller pair 14, 17 of the drafting unit than the device 43. The piecing of the new slivers will then be carried out without any interruption of the spinning operation. Particularly when coarse yarn counts are spun, this process can be used in which there is virtually no loss of fiber material.

Should nevertheless impermissible thick points occur in the double yarn 10 because of one or both connecting points, this is detected by the yarn cleaner 48. The yarn cleaner 48 will then emit a corresponding signal to the control 50 which will then interrupt the spinning operation so that subsequently a piecing operation will be carried out by an automatic servicing device which is not shown. During this spinning operation, the thick point or the thick points are removed so that they do not reach the spool package. In this case, it may be provided that the automatic servicing device carries out this piecing after a sliver piecing according to a special program during which it withdraws the yarn components taken up during the piecing behind the air nozzles 31, 32 until the sections which contain the connecting points of the slivers have been removed, after which the piecing is carried out by connecting the new spun yarn components 8, 9 with a double yarn 10 withdrawn from the package 11. According to a modification of this process, it is provided that the control 50, after an interruption of the spinning operation, first closes the drafting units but holds the suction nozzles 46, 47 in the shown position. The yarn components 8, 9 leaving the drafting units are then taken in into the suction nozzles 46, 47 for so long until the sections containing the connecting points have travelled through the drafting units. Subsequently, the normal piecing program will then be carried out during which the suction nozzles 46, 47 and the air nozzles 30, 31; 32, 33 are brought into the operating positions.

In the case of another process, it is provided that, when one of the sliver detectors 44 or 45 reports the running-out of the sliver 6 or 7, the spinning operation is interrupted by the control 50, that is, the drafting units are opened, the package 11 is lifted off, and the suction nozzles 46, 47 and the air nozzles 30, 31', 32, 33 are brought into the shown inoperative position. Then the piecing of the starting portions of the new slivers takes place by means of devices 42, 43 which in this case, as illustrated, are arranged side-by-side so that the connecting points occur at the same locations. Should one of the slivers 6 or 7 not have run out, it is cut off so that an identical connection is created on this sliver 6 or 7. Before a piecing, the control 50 will then close the drafting units, while the suction nozzles 46, 47 remain in the illustrated position. It is only after the sections of the yarn components 8, 9 have travelled through the drafting units which contain the connecting points, that the suction nozzles 46, 47 and the air nozzles 30, 31 are brought into the operative position, after which a piecing is carried out.

However, in the case of a modified embodiment, this process is carried out such that, with the closing of the drafting units, the suction nozzles 46, 47 and the air nozzles 30, 31; 32, 33 are also brought into the operative position, in which case a piecing is then carried out immediately. This piecing takes place by means of a special piecing program which is requested by the control 50 at the automatic servicing device. In the case of this special piecing program, the yarn components 8, 9 are withdrawn by the servicing device, before the actual piecing, that is, the connecting of the yarn components 8, 9 with the double yarn withdrawn from the package 11, until the sections of the yarn components 8, 9, which contain the connecting points between the old and the new slivers, have travelled into the servicing device so far that, during the piecing, they no longer enter into the double yarn.

In the case of a third process, it is provided that, although the sliver detectors 44, 45 report the running-out of the slivers 6, 7 to the control, this control at first does not yet interrupt the spinning operation. The piecing of the new slivers by means of devices 42, 43 is carried out during the continued spinning operation. The spinning operation will be continued until the sections of the slivers 6, 7 which contain the connecting points have passed through the drafting units. This may be indicated by the control 50 by way of a time function. The spinning operation will then be interrupted. The sections of the yarn components 8, 9 which contain the connecting points, in this case, have at least partially moved onto the package 11. During the subsequent piecing operation, they are removed from this package by the automatic servicing device. This is carried out in such a manner that a withdrawal of the wound-up double yarn 10 which is to be connected with the new spun yarn components 8, 9, during the piecing, is carried out a little longer than normal and the sections of yarn containing the connecting points due to the sliver splicing are removed.

Figure 2:
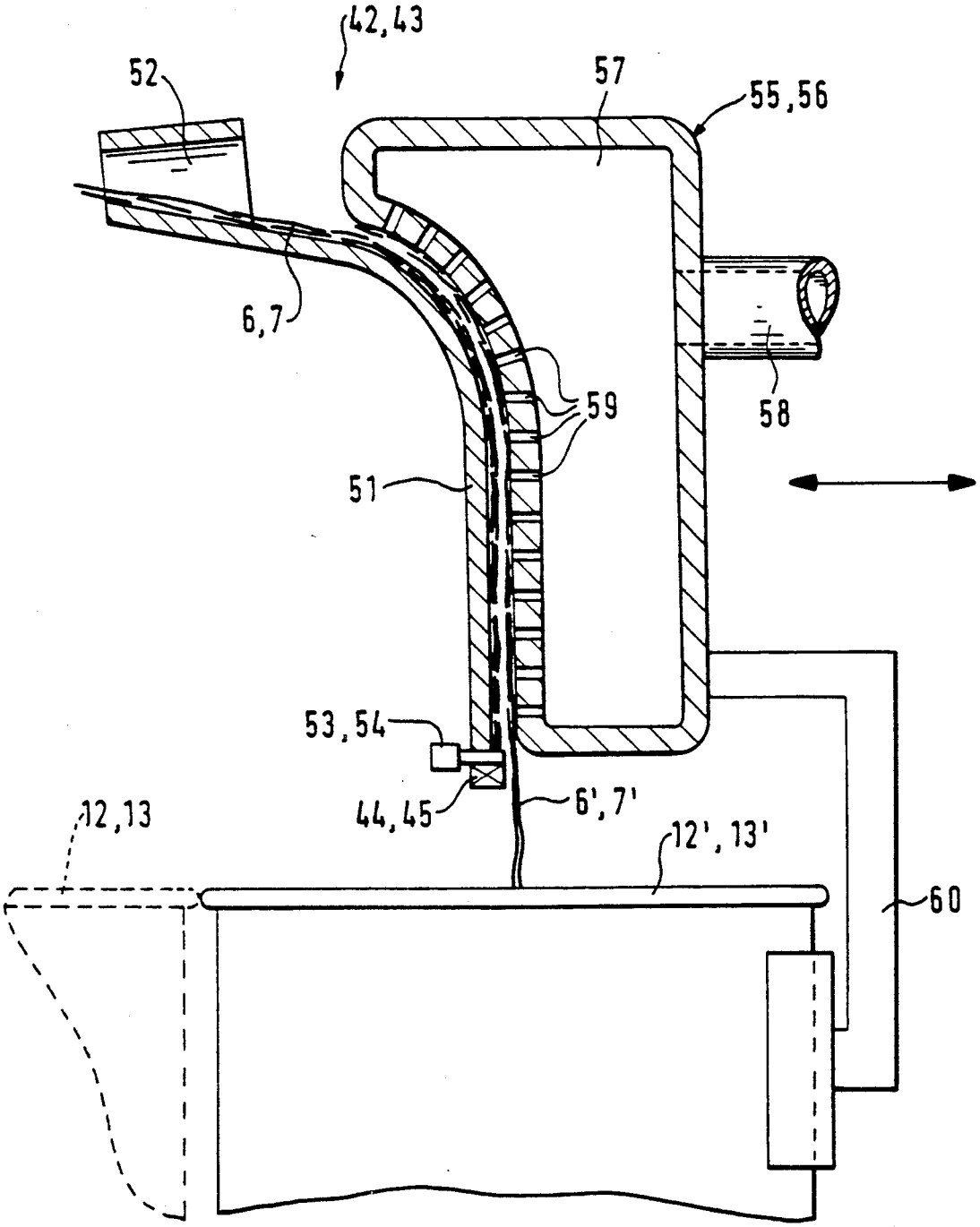
FIG. 2 is an enlarged sectional schematic view through elements for carrying out the piecing of the slivers at the spinning unit of FIG. 1.

FIG. 2 schematically illustrates a preferred embodiment for the devices 42; 43 for connecting the ends of the entering slivers 6, 7 with the starting portions of new slivers 6', 7'. These devices 42, 43 each comprise stationary guiding plates 51 by way of which the slivers 6, 7 travel to the drafting units through a feeding hopper 52. The sliver detectors 44, 45 are arranged on the ends of the guiding plates 51 which face away from the drafting units. These sliver detectors 44, 45 are followed directly by devices 53, 54 by means of which the slivers 6, 7 can be cut. These are, for example, scissor-type cutting elements which are also connected to the control 50. As soon as one of the sliver detectors 44, 45 reports the absence of a sliver 6, 7, the cutting elements 53, 54 are actuated.

The devices 42, 43 for the connecting also each comprise holding and applying elements 55, 56 which have a chamber 57 connected to a pressure medium supply line 58. The walls of the chamber 57 facing the guiding plates 51 are provided with perforations 59.

The holding and applying elements 55, 56 are first situated in a position in which they maintain a larger distance to the guiding plates 51. Their chambers 57 are acted upon by a vacuum. The starting portions of the new slivers 6', 7' of cans 12', 13' are applied to their perforated walls so that these starting portions are held in readiness.

Upon a corresponding signal of the control 50, which is triggered by the sliver detectors 44, 45, the holding and applying elements 55, 56 are now applied to the guiding plates 51. Subsequently, their chambers 57 are acted upon by compressed air so that the starting portions of the new slivers 6', 7' are connected with the ends of the entering slivers 6, 7. It is sufficient for this purpose that the starting portions of the new slivers 6', 7' adhere to the ends of the old slivers 6, 7 without the occurrence of a significant mixing of fibers. Then the holding and applying elements 55, 56 are moved back. Since the slivers 6, 7 are pulled into the drafting units at a relatively low speed, this piecing of the new sliver 6', 7' may be carried out without any interruption of the spinning operation.

The holding and applying elements 55, 56 are provided with pulling arms 60 which, when the holding and applying elements 55, 56 are applied, change the cans 12', 13' situated in the reserve position into the operating position and, in the process, push the old cans 12, 13 out of this operating position.

The holding and applying elements 55, 56 may be components of the respective spinning units and may be actuated by the control 50. In this embodiment, the new cans 12', 13' may then be brought into the readiness position by an operator, in which case, the operator also places the new slivers 6', 7' onto the walls of the chambers 57.

In the case of a modified embodiment, it is provided that the holding and applying elements 56 are components of a movable servicing device which is called by a signal given by the control 50 of the concerned spinning unit, and then the connecting is carried out between the old slivers 6, 7 and the new slivers 6', 7'. In this case, it will, as a rule, be necessary that the spinning operation is interrupted prior to the connecting of the old slivers 6, 7 with the new slivers 6', 7'. During the connecting, the new slivers 6', 7' arrive in the area of the sliver detectors 44, 45 so that then the control receives the signal that the connecting is being carried out. The control can then, by means of another signal, call the servicing device which carries out the piecing operation.

When a movable servicing device is provided, which contains holding and applying elements 56, this servicing device may also carry spare cans 12', 13' along with it and, if required, feed these to the spinning unit at which a new sliver is required.

Figure 3:
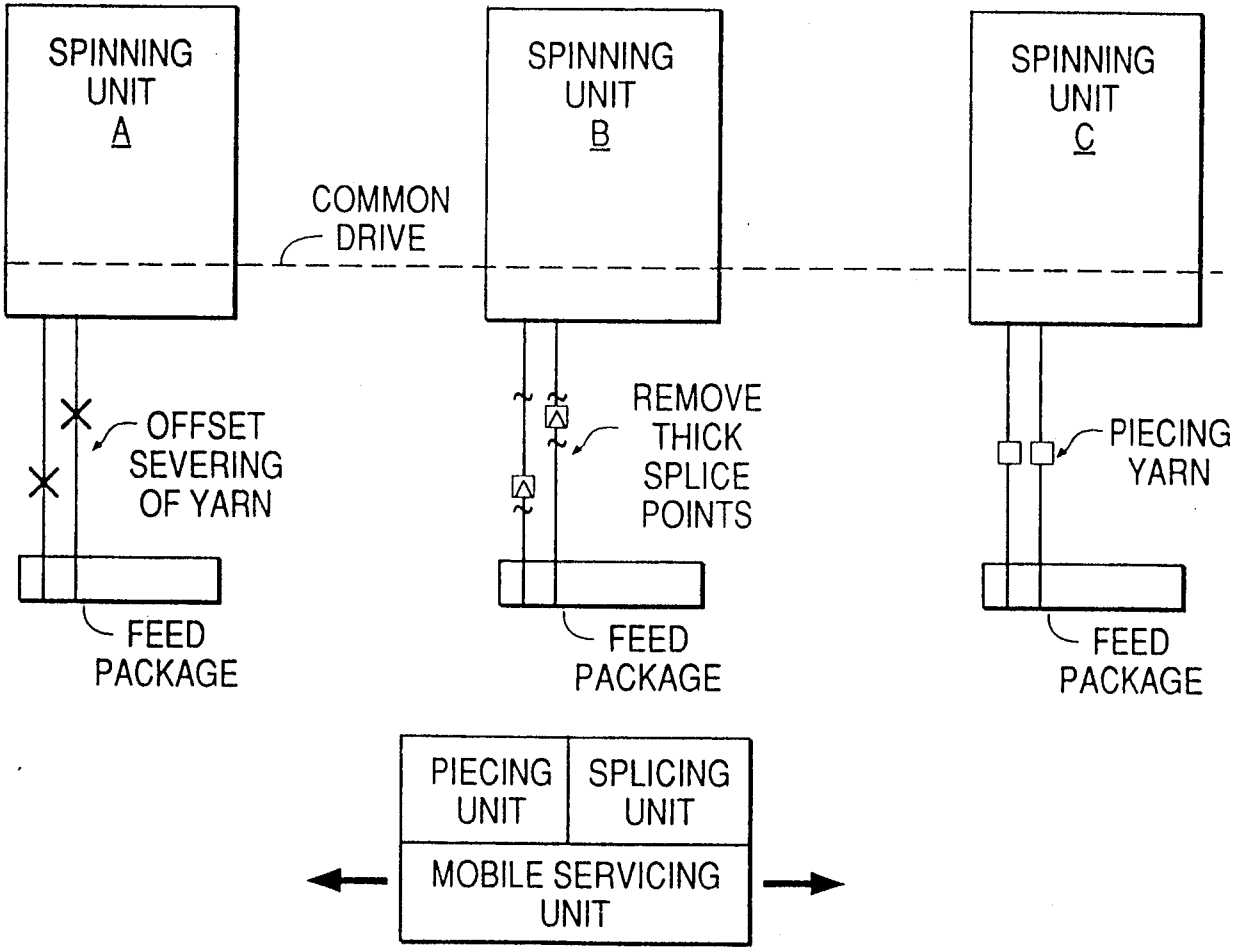
FIG. 3 schematically depicts operation of a mobile servicing unit carrying out yarn splicing and piecing operations at a multi-spinning unit spinning machine, in accordance with preferred embodiments of the invention.

FIG. 3 schematically depicts a mobile servicing unit for carrying out the above-described operations. Three spinning units A, B, and C are depicted which have a common drive. At spinning unit A, the offset severing of yarn is schematically shown. At spinning unit B, the removal of thick splice points is schematically shown. At spinning unit C, the piecing of the yarn is schematically shown. The mobile servicing unit is selectively movable to the respective units for carrying out these operations.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning process comprising spinning first and second yarn components at a spinning unit from respective first and second slivers, and guiding said first and second yarn components together to form a double yarn to be wound together as a feeding package for a subsequent twisting operation, said process further comprising the sequential steps of:

feeding first and second slivers to the spinning unit to be spun, detecting interruption of the feeding of at least one of the first and second slivers to the spinning unit, severing the first and/or second slivers such that the two old sliver ends are offset with respect to one another in the travel direction of the slivers being fed to the spinning unit, and connecting the old sliver ends of the first and second silvers with respective new sliver ends, thereby forming respective first and second slivers with respective connections which are spaced from one another in the travel direction of the slivers.

2. A process according to claim 1, further:

monitoring the thickness of the double yarn spun at the spinning unit, interrupting spinning operation at the spinning unit in response to detection of an undesirably thick double yarn section by said monitoring, removing the undesirably thick double yarn section, and piecing the respective yarn components with the undesirable thick yarn section removed.

3. A process according to claim 2, comprising arranging cutting and splicing devices at each spinning unit of a multi-unit spinning machine for accomplishing said steps of severing and connecting.

4. A process according to claim 3, comprising selectively moving a mobile servicing unit between servicing positions at the respective spinning units to carry out said piecing step.

5. A process according to claim 2, comprising selectively moving a mobile servicing unit between servicing position at the respective spinning units to carry out said piecing step.

6. A process according to claim 5, comprising carrying out said connecting by connecting devices carried at least in part by the mobile servicing unit.

7. A process according to claim 2, comprising selectively moving a mobile servicing unit between servicing positions at the respective spinning units to carry out said piecing step.

8. A process according to claim 7, comprising carrying out said connecting by connecting devices carried at least in part by the mobile servicing unit.

9. A process according to claim 1, comprising arranging cutting and splicing devices at each spinning unit of a multi-unit spinning machine for accomplishing said steps of severing and connecting.

10. A spinning process comprising spinning first and second yarn components at a spinning unit from respective first and second slivers with the first and second yarn components being guided together to form a double yarn to be wound together as a feeding package for a subsequent twisting operation, said process further comprising the sequential steps of:

feeding first and second slivers to the spinning unit, detecting interruption in the feed of at least one of the first and second slivers, severing the first and/or second slivers such that the two old sliver ends are disposed side-by-side with respect to one another in the travel direction of the silvers being fed to the spinning unit, connecting the old sliver ends of the first and second slivers with respective new silver ends, thereby forming respective first and second slivers with respective connections which are disposed side-by-side in the travel direction of the slivers, and subsequently removing the connections from the yarn components being wound together on the feeding package.

11. A process according to claim 10, further comprising:

interrupting spinning operation at the spinning unit during said severing and connecting, and piecing the yarn components subsequent to said sliver splicing with removal of the sections of yarn components containing sliver connections.

12. A process according to claim 11, wherein said removal of the sections of yarn components containing sliver connections is accomplished before the piecing.

13. A process according to claim 11, wherein said removal of the sections of yarn components containing sliver connections is accomplished during the piecing.

14. A process according to claim 10, comprising interrupting the spinning operation after the connecting of the ends of the slivers with the starting portion of one new sliver respectively and after the section of the double yarn containing the connections has travelled onto the package, and subsequently carrying out a piecing operation during which the section of the double yarn containing the connections is removed.

15. A process according to claim 10, comprising carrying out the severing and cutting by devices arranged at each spinning unit of a multi-unit spinning machine.

16. A process according to claim 10, comprising carrying out said connecting by connecting devices carried at least in part by the mobile servicing unit.

17. Sliver splicing apparatus for a spinning unit for spinning first and second yarn components from respective first and second slivers with said first and second yarn components being guided together to form a double yarn to be wound together as a feeding package for subsequent twisting operations, said spinning unit including feeding apparatus for feeding first and second slivers to a spinning unit, said sliver splicing apparatus comprising:

detecting apparatus for detecting interruption in the feed of at least one of the first and second slivers, severing apparatus for severing at least one of the first and second slivers such that the two old sliver ends are offset with respect to one another in the travel direction of the slivers being fed to the spinning unit, and connecting apparatus for connecting the old sliver ends of the first and second slivers with respective new sliver ends, thereby forming respective first and second slivers with respective spliced connections spaced from one another in the travel direction of the slivers.

18. Apparatus according to claim 17, wherein said detecting apparatus includes sliver detecting devices disposed at an inlet side of the spinning unit, wherein said severing apparatus includes sliver severing devices disposed at the inlet side of the spinning unit, and wherein said connecting apparatus includes at least one part for connecting the old and new sliver ends, which at least one part is disposed at the inlet side of the spinning unit.

19. Apparatus according to claim 18, wherein the sliver detecting devices are connected to a control of the spinning unit which is connected with devices for interrupting the spinning operation.

20. Apparatus according to claim 18, wherein the at least one part for connecting the old and new sliver ends are arranged at a varying distance from an inlet of a drafting unit assigned to one sliver respectively.

21. Apparatus according to claim 18, wherein the at least one part for connecting the old and new sliver ends have two holding and applying elements which each receive the starting portion of a new sliver and which can be applied to one supporting element respectively guiding a sliver end.

22. Apparatus according to claim 18, wherein the spinning unit is provided with a yarn cleaner assigned to the double yarn for detecting undesirable thick points in the double yarn at a position downstream of spinning means of the spinning unit and upstream of a yarn package being formed by the double yarn.

23. Apparatus according to claim 17, wherein said spinning unit is part of a multi-spinning unit machine having a plurality of spinning units driven by common drive means, wherein said detecting apparatus includes sliver detecting devices disposed at the inlet side of the spinning unit, wherein said severing apparatus includes sliver severing devices disposed at an inlet side of the spinning unit, and wherein said connecting apparatus includes at least one part for connecting the old and new sliver ends which at least one part is disposed at the inlet side of the spinning unit.

24. Apparatus according to claim 23, wherein said connecting apparatus includes at least one further part carried by a mobile servicing device which is selectively movable between servicing positions adjacent the respective spinning units.

25. Sliver splicing apparatus for a spinning unit for spinning first and second yarn components from respective first and second slivers with said first and second yarn components being guided together to form a double yarn to be wound together as a feeding package for subsequent twisting operations, said spinning unit including feeding apparatus for feeding first and second slivers to a spinning unit, said sliver splicing apparatus comprising:

detecting apparatus for detecting interruption in the feed of at least one of the first and second slivers, severing apparatus for severing at least one of the first and second slivers such that the two old sliver ends are disposed side-by-side with respect to one another in the travel direction of the slivers being fed to the spinning unit, connecting apparatus for connecting the old sliver ends of the first and second slivers with respective new silver ends, thereby forming respective first and second slivers with respective connections disposed side-by-side in the travel direction of the slivers, and spliced connection removal apparatus for removing the spliced connections from the yarn components being wound together on the feeding package.

26. Apparatus according to claim 25, wherein said spinning unit includes piecing apparatus for performing a piecing operation at the spinning unit, and wherein said removal apparatus includes apparatus for removal of the spliced connection sections before a respective piecing operation at the spinning unit.

27. Apparatus according to claim 25, wherein said spinning unit includes piecing apparatus for performing a piecing operation at the spinning unit, and wherein said splicing connection removal apparatus includes apparatus for removal of the connection sections during a piecing operation at the spinning unit.

28. Apparatus according to claim 25, wherein said spinning unit includes winding apparatus for winding yarn on a feeding package and piecing apparatus for performing a piecing operation at the spinning unit, and wherein said connection removal apparatus includes apparatus for severing out said connection after winding thereof on a feeding package, with subsequent piecing of the yarn from the feeding package to newly spun yarn at the spinning unit.

* * * * *